United States Patent [19]

Silcock et al.

[11] Patent Number: 4,576,133

[45] Date of Patent: Mar. 18, 1986

[54] LIQUID FUEL INJECTION PUMPING APPARATUS

[75] Inventors: Terence M. B. Silcock, Pinner; Colin T. Timms, Harrow Weald, both of England

[73] Assignee: Lucas Industries Public Limited Company, Birmingham, England

[21] Appl. No.: 688,516

[22] Filed: Jan. 3, 1985

[30] Foreign Application Priority Data

Jan. 21, 1984 [GB] United Kingdom ..... 8401626

[51] Int. Cl.[4] ..... F02M 39/00

[52] U.S. Cl. ..... 123/458; 123/459; 123/506

[58] Field of Search ..... 123/458, 459, 460, 447, 123/503, 506, 451, 198 D

[56] References Cited

U.S. PATENT DOCUMENTS

| | | | |
|---|---|---|---|
| 4,351,283 | 9/1982 | Ament | 123/458 |
| 4,474,158 | 10/1984 | Mowbray | 123/458 |

FOREIGN PATENT DOCUMENTS

| | | | |
|---|---|---|---|
| 57-41462 | 3/1982 | Japan | 123/506 |
| 707217 | 4/1954 | United Kingdom | 123/451 |
| 2061403 | 5/1981 | United Kingdom | 123/458 |

*Primary Examiner*—Magdalen Y. C. Moy

[57] ABSTRACT

A liquid fuel injection pumping apparatus comprises a plunger reciprocable in a bore, an electrically operated spill valve to divert fuel pumped by the plunger to prevent it reaching an outlet. In an emergency the spill valve can be closed and valve means used to provide a restricted flow of fuel to the bore to allow continued fuel supply to an associated engine. The plunger defines a spill path which is opened at a predetermined position during the inward movement of the plunger and this terminates delivery of fuel from the bore to the outlet.

10 Claims, 4 Drawing Figures

LIQUID FUEL INJECTION PUMPING APPARATUS

This invention relates to a liquid fuel injection pumping apparatus for supplying fuel to an internal combustion engine, the apparatus being of the kind comprising a high pressure reciprocable plunger fuel injection pump having an outlet connected in use, to an injection nozzle of an associated engine, a low pressure supply pump for supplying fuel under pressure to the high pressure pump during the filling periods thereof, passage means connecting the supply pump to an inlet of the high pressure pump, an electrically controlled spill valve operable to divert fuel at high pressure from the high pressure pump during inward movement of the plunger, thereby to control the amount of fuel supplied through said outlet, manual means operable to prevent flow of fuel through the spill valve in the event of electrical failure, and a valve associated with said passage means and operable in the event of electrical failure to provide a variable restriction to the flow of fuel through said passage means to the high pressure pump whereby the apparatus can continue to supply fuel to an associated engine.

With such an apparatus in the normal operation thereof, the spill valve is utilized to provide control of fuel quantity and the timing of delivery thereof. In the emergency mode however with the spill valve closed the delivery of fuel once it has started, will continue as long as the plunger of the high pressure pump is being moved in the pumping or inward direction. This means that delivery of a predetermined quantity of fuel will start later in the plunger inward stroke and this can lead to an undesirable level of smoke in the engine exhaust.

The object of the invention is to provide an apparatus of the kind specified in a simple and convenient form.

According to the invention an apparatus of the kind specified comprises a spill path from the pumping chamber of the high pressure pump, said spill path being uncovered at a predetermined position during the inward movement of the plunger to terminate delivery of fuel by the apparatus.

According to a further feature of the invention said spill path is arranged to be closed during normal operation of the apparatus for the purpose of starting the associated engine.

An example of a fuel injection pumping apparatus in accordance with the invention will now be described with reference to the accompanying drawings in which.

Figure 1:
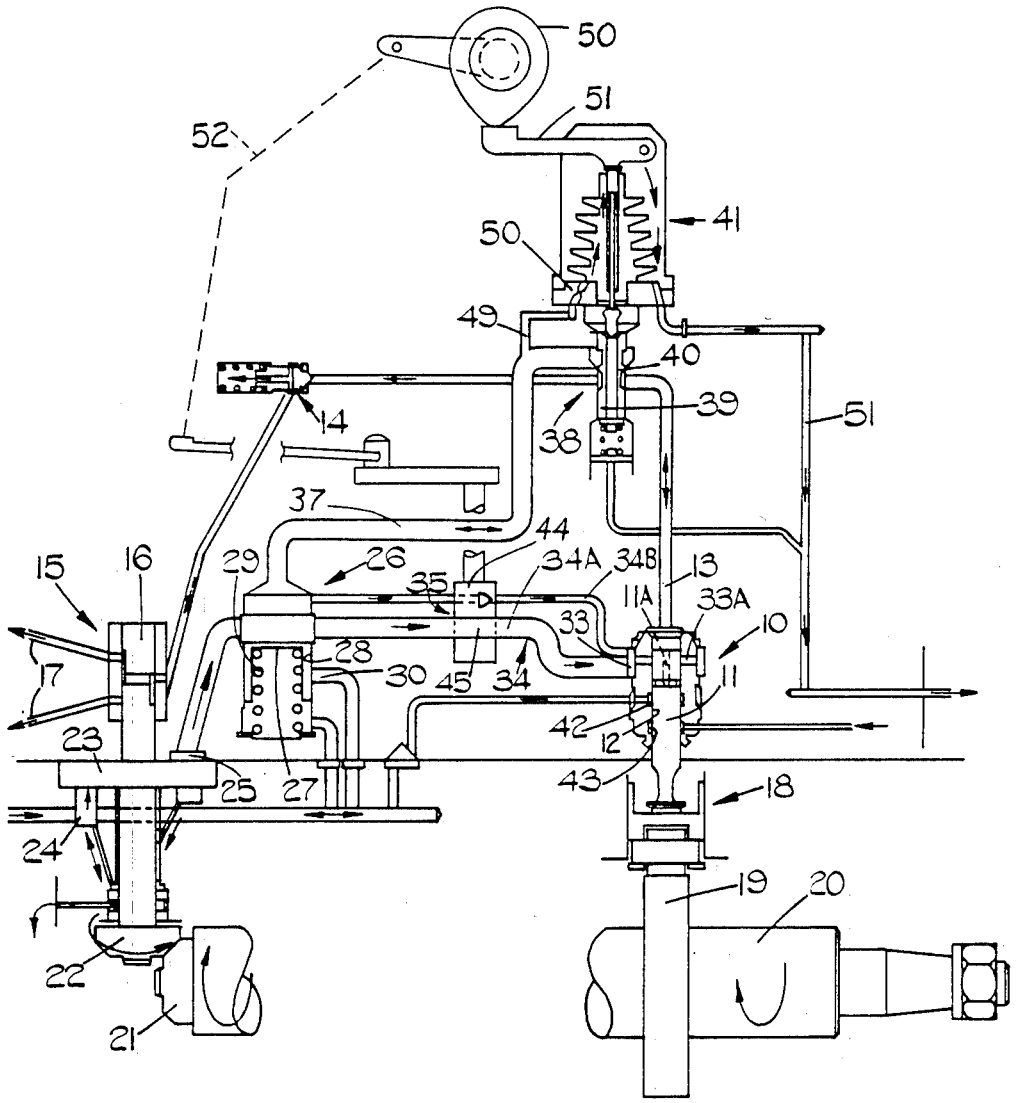
FIG. 1 is a diagrammatic representation of the apparatus.

Referring to the drawings, the apparatus comprises a high pressure fuel injection pump generally indicated at 10 and including a plunger 11 reciprocable in a bore 12 which has an outlet passage 13 connected by way of a spring loaded delivery valve 14 to a fuel distributor generally indicated at 15 and which includes a rotary distributor member 16. The distributor member distributes fuel delivered during successive inward movements of the pumping plunger, to a number of outlets 17 in turn, the outlets being connected to the fuel injection nozzles respectively of the associated engine.

The plunger 11 is connected to a tappet mechanism indicated at 18, and is driven upwardly by means of a cam 19 mounted upon a drive shaft 20 and is driven downwardly by a lever and further tappet mechanism (not shown) which is also actuated by the cam. Preferably the cam is a constant rate cam. The drive shaft also carries a bevel gear 21 with which meshes a further bevel gear 22 coupled to the distributor member 16. The drive shaft is driven in timed relationship with the associated engine. The shaft, of which the distributor member 16 forms part, carries the rotor generally indicated at 23, of a low pressure fuel supply pump having an inlet 24 and an outlet 25. The inlet in use, is connected to a source of fuel and the outlet is connected to a fuel reservoir generally indicated at 26. The fuel reservoir comprises a piston 27 which is slidably mounted within a cylinder 28 and the piston is biased towards one end of the cylinder by means of a coiled compression spring 29. Formed in the wall of the cylinder is a port 30 which is uncovered by the piston when the latter has moved a predetermined distance against the action of the spring 29. The port 30 communicates with the inlet 24 of the low pressure pump and the piston acts to control the output pressure of the pump. The end of the cylinder 28 containing the spring 29 also communicates with the inlet 24 but may communicate directly with the fuel supply tank.

Formed in the wall of the bore 12 which contains the plunger 11 is a plurality of ports 33A which communicate with a circumferential groove 33 and this constitutes a fuel inlet for the high pressure pump. The groove 33 communicates by way of passage means 34 with the reservoir 26 and a valve 35 to be described, controls flow of fuel through the passage means 34. The reservoir also communicates by way of a passage 37, with a spill valve which is generally indicated at 38. The spill valve includes a spring loaded valve member 39 having a head 40 which can engage with a seating when a solenoid device 41 associated with the valve 38, is energised, the spring urges the head 40 away from the seating and this will allow fuel to flow from the passage 13 to the passage 37.

The plunger 11 when at its maximum outward or downward position, as determined by the cam 19, uncovers the ports 33A to the pumping chamber which is defined by the bore 12 and the plunger. Assuming for the moment that the valve 35 is open and that the plunger is at the outermost limit of its stroke with the pumping chamber full of fuel. As the drive shaft 20 rotates inward movement will be imparted to the plunger 11 and the ports 33A will be covered by the end of the plunger. The fuel in the pumping chamber is now displaced along the passage 13 and if the spill valve 38 is in the closed position, the fuel will be displaced past the delivery valve 14 to the distributor 15 and then to an outlet 17. If during this displacement of fuel or before displacement commences, the spill valve 38 is opened, the displaced fuel will flow between the head 40 and its seating, and it will be returned by way of the passage 37 to the reservoir 26. As a result no fuel will flow to the outlet 17. The spill valve can be operated at any time to determine the timing of fuel delivery and the quantity of fuel delivered. The plunger 11 is provided with a central passage 11A forming a spill path, which opens into a groove formed on the periphery of the plunger at a position to be uncovered to the ports 33A before the end of inward movement of the plunger. In normal use however the passage 11A is placed in communication with the ports 33A after the opening of the spill valve 38 to terminate delivery of fuel, so that in normal use the flow of fuel along the passage 11A from the pumping chamber will be small. A leakage groove 42 is provided in the bore 12 and is connected to the fuel inlet 24 and a further groove 43 is provided which is connected to a source of lubricant under pressure. The spillage of fuel through the passage 11A may take place to a drain on the inlet of the low pressure pump. This is achieved by providing a further port in the wall of the bore 12 and with which the groove in the plunger can communicate rather than with the ports 33A.

The outward movement of the plunger is effected by the aforesaid further tappet mechanism and if the spill valve 38 remains in the open position fuel can flow into the bore 12 by way of the spill valve from the passage 37. Some fuel will flow into the bore when the ports 33A are uncovered by the plunger and if the spill valve is closed during the downward movement of the plunger all the fuel will flow into the bore by way of the ports 33A such flow taking place only when the ports are uncovered. The accumulator assists the low pressure pump in the filling of the bore 12 which in normal operation is completely filled with fuel prior to inward movement of the plunger taking place. The accumulator is recharged by the low pressure pump during the inward stroke of the plunger.

In the event of failure of the control system which powers the solenoid device 41 and/or the device itself, the spill valve 38 because of its spring loading will move to the open position and thereby no fuel can be supplied to the associated engine. The engine therefore is protected because if in the event of failure the spill valve remained in the closed position, the maximum amount of fuel would be supplied to the engine which could lead to overspeeding of the engine, possibly resulting in damage thereto.

Figure 2:
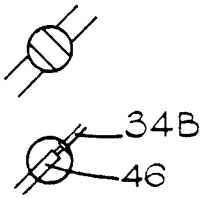
FIGS. 2 and 3 show different settings of a part of the apparatus of FIG. 1.
Figure 3:
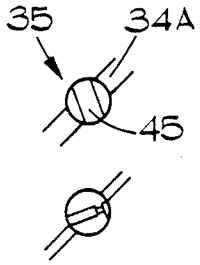

In order to enable a limited quantity of fuel to be supplied to the engine in an emergency, the aforementioned valve 35 is provided. The valve 35 as previously mentioned, controls fuel flow through the passage means 34 which in fact comprises two passages 34A and 34B. Passage 34A is of substantial size to minimise any restriction to the flow of fuel to the bore 12 during normal operation of the apparatus. The valve 35 includes an angularly movable valve member 44 in which is formed a drilling 45 having a size to connect the two parts of the passage 34A without imposing restriction, when the valve member is in a normal run position as shown in FIG. 1. The passage 34B is of reduced size and may in itself impose some restriction to the flow of fuel. The valve member 44 has a drilling 46 which in an emergency run position of the valve member as shown in FIG. 2, connects the two parts of the passage 34B. The drilling 46 is constructed to form a restrictor which provides a restriction to the flow of fuel and in addition, the drilling at one end opens onto a flat on the periphery of the valve member whereby variable restriction to fuel flow can be obtained by angular movement of the valve member. In a stop position of the valve member which is shown in FIG. 3 and which lies between the aforesaid positions, both drillings are out of register with their respective passages and so no fuel flow can take place.

In the situation where failure of the control system and/or the solenoid device 41 has taken place, the valve 35 is moved to the position shown in FIG. 2. This will enable a limited flow of fuel to take place to the bore 12. However, the spill valve 38 must be closed otherwise the bore during downward movement of the plunger will be filled with fuel but what is more important, during upward movement of the plunger all the fuel would be returned to the reservoir. A mechanical linkage is therefore provided between the valve 35 and the spill valve 38 including a cam 50, and a lever 51 coupled by means of linkage 52 to the valve means 35 to ensure that when the valve 35 is moved to its second position the spill valve is moved to its closed position. With the spill valve closed the flow of fuel to the pumping chamber of the high pressure pump will be restricted.

Moreover, since the spill valve 38 is closed, the passage 11A forms a spill path from the pumping chamber when it is brought into communication with the ports 33A. The practical effect of this is that for a given quantity of fuel to be delivered to the engine, delivery of fuel will have to take place earlier than would be the case if the same quantity of fuel were delivered but without the passage 11A. The earlier delivery of fuel means that the production of smoke by the engine will be minimised. Although the amount of fuel delivered remains the same the amount of fuel supplied to the bore when the passage 11A is provided has to be increased because of the spillage of fuel through the passage 11A which terminates fuel delivery.

As described the fuel is spilled back through the restriction offered by the setting of the valve member 44 and the passage 46 and it has been found that this provides for a reason which is not fully understood, a rapid reduction of the amount of fuel delivered by the apparatus whatever the degree of restriction offered by the setting of the valve member 44, as a particular engine speed is approached. In one example fuel delivery fell sharply up to an engine speed of 2000 RPM. Thereafter the fuel supplied continued to decrease as the engine speed increased. Unfortunately it was found that angular movement of the valve member 44 to vary the fuel flow did not produce very satisfactory results and furthermore that for a given setting of the valve member there was a rapid increase in the amount of fuel supplied by the apparatus as the engine speed reduced.

Figure 4:
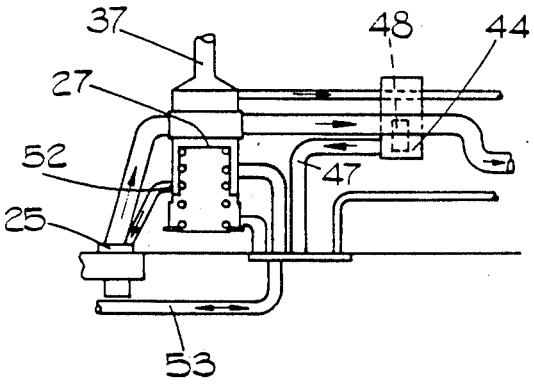
FIG. 4 shows a modification to part of the apparatus of FIG. 1.

In order to overcome this problem and as shown in FIG. 4, means is provided to reduce the output pressure of the low pressure pump as the valve member 44 is moved to reduce the fuel quantity. One way of achieving this is to provide a variable bleed from the accumulator to the inlet of the low pressure pump. For this purpose a further passage 47 which communicates with the inlet 24 of the low pressure pump is provided and this opens onto the periphery of the valve member 44. Moreover, there is formed on the valve member a flat 48 which is able to establish communication between the passage 47 and the portion of the passage 34A which communicates with the accumulator. Such communication will have the effect of lowering the output pressure of the low pressure pump. It is arranged that in the stop position of the valve member 44 maximum communication occurs and as the valve member is turned to the emergency run position the flat moves out of register with the aforesaid portion of the passage 34A. The effect is to allow the output pressure of the low pressure pump to gradually increase as the valve member 44 in the emergency run position is moved to increase the quantity of fuel supplied by the apparatus and vice versa. The resulting fuel delivery characteristics are much improved and provide the engine operator with an improved degree of control.

The valve member 44 is movable to another position for the purpose of starting the associated engine in normal circumstances when the solenoid device 41 and its control circuit are operating correctly. For starting purposes when the engine is cold, the delivery of fuel should take place as late in the compression stroke as possible to ensure that the air in the cylinders of the engine is as hot as possible. The quantity of fuel supplied during the starting phase is controlled by the spill valve 38. However, the passage 11A which has the effect of ensuring early delivery of fuel in the emergency running condition would prevent supply of fuel at the most desirable time when starting the engine. The valve member 44 is therefore moved to a position in which the passages 34A and 34B are closed. Moreover the mechanical linkage between the valve member 44 and the spill valve is such that in this position of the valve member the spill valve can operate without hinderance.

When operating in the failure mode i.e. with the position of the valve member 44 as shown in FIG. 2, the valve member is set to its maximum fuel position for the purpose of starting the engine. Even at the low cranking speed sufficient fuel will be drawn into the pump chamber to enable starting of the associated engine to take place.

Various other passages are shown in FIG. 1 of the drawings, one such passage being indicated at 49, this passage providing a flow of fuel from the reservoir 26 by way of the passage 37, for the purpose of cooling the solenoid device 41. The passage 49 has a restrictor 50 at its point of entry into the device 41 to restrict the flow of fuel and the fuel leaving the solenoid device flows to a drain, conveniently to the supply tank, by way of an outlet passage 51.

FIG. 4 shows a modification to the accumulator whereby the apparatus can be primed with fuel. The modification comprises an additional port 52 formed in the side wall of the cylinder 28 and connected to the outlet 25 of the low pressure pump. The port 52 in the normal use of the apparatus is covered by the piston 27 but if fuel under pressure is supplied to the passage 53 which is connected to the inlet of the pump the piston 27 will be moved away from the lower end of the cylinder by fuel under pressure flowing into the cylinder. The port 52 will therefore be uncovered and fuel can then flow into the passages connected to the outlet of the low pressure pump. The flow is restricted by a restrictor in series with the port and a substantial amount of the air in the accumulator chamber and in the passage 37 can escape by way of the bleed into the housing of the device 41.

We claim:

1. A liquid fuel injection pumping apparatus for supplying fuel to an internal combustion engine, comprising a high pressure reciprocable plunger fuel injection pump having a pumping chamber and an outlet connected in use, to an injection nozzle of an associated engine, a low pressure supply pump for supplying fuel under pressure to the high pressure pump during the filling periods thereof, passage means connecting the supply pump to an inlet of the high pressure pump, an electrically controlled spill valve operable to divert fuel at high pressure from the high pressure pump during inward movement of the plunger, thereby to control the amount of fuel supplied through said outlet, manual means operable to prevent flow of fuel through the spill valve in the event of electrical failure, a valve associated with said passage means and operable in the event of electrical failure to provide a variable restriction to the flow of fuel through said passage means to the high pressure pump whereby the apparatus can continue to supply fuel to an associated engine, a spill path from the pumping chamber of the high pressure pump, fuel flowing through said spill path flowing along said passage means, said spill path being uncovered at a predetermined position during inward movement of the plunger to terminate delivery of fuel by the apparatus.

2. An apparatus according to claim 1 including means operable in the event of electrical failure to reduce the output pressure of the low pressure pump.

3. An apparatus according to claim 2 in which said means is operable in conjunction with the valve associated with said passage means, whereby the output pressure of the low pressure pump increases as said valve is moved to increase the quantity of fuel supplied by the apparatus.

4. A liquid fuel injection pumping apparatus for supplying fuel to an internal combustion engine, comprising a high pressure reciprocable plunger fuel injection pump having a bore defining a pumping chamber in which a plunger is mounted, an outlet connected to one end of the bore, a port formed in the wall of the bore, said port being covered by the plunger during the initial inward movement thereof towards said one end of the bore, said high pressure pump being connected in use to an injection nozzle of an associated engine, a low pressure supply pump for supplying fuel under pressure to the high pressure pump during the filling periods thereof, passage means connecting the supply pump to said port of the high pressure pump, an electrically controlled spill valve operable to divert fuel at high pressure from the high pressure pump during inward movement of the plunger, thereby to control the amount of fuel supplied through said outlet, manual means operable to prevent flow of fuel through the spill valve in the event of electrical failure, a valve associated with said passage means and operable in the event of electrical failure to provide a variable restriction to the flow of fuel through said passage means to the high pressure pump whereby the apparatus can continue to supply fuel to an associated engine, a spill path from the pumping chamber of the high pressure pump, said spill path being uncovered at a predetermined position during inward movement of the plunger to terminate delivery of fuel by the apparatus, said spill path comprising a passage defined by the plunger, the passage opening into said one end of the bore and onto the periphery of the plunger at a position to connect with said port after a predetermined movement of the plunger towards said one end of the bore, the fuel displaced along said spill path being returned to said supply pump by way of said valve.

5. An apparatus according to claim 4 in which said passage is formed in the plunger and communicates with a circumferential groove on the periphery of the plunger.

6. An apparatus according to claim 5 in which the valve associated with said passage means comprises a valve member movable between three positions, in the first of which substantially no restriction is imposed to the flow of fuel along said passage means, in the second of which flow of fuel along said passage means is prevented, and in the third of which the flow of fuel along said passage means is at a restricted rate.

7. An apparatus according to claim 6 in which said valve member in the third position establishes a connection from the outlet of the low pressure pump to a drain whereby the outlet pressure of the low pressure pump is reduced.

8. An apparatus according to claim 6 or 7 in which the valve member during normal operation of the apparatus is movable to a position to prevent flow of fuel along said spill path whereby fuel can be displaced through said outlet during the whole of the inward movement of the plunger.

9. A liquid fuel injection pumping apparatus for supplying fuel to an internal combustion engine, comprising a high pressure reciprocable plunger fuel injection pump having a pumping chamber and an outlet connected in use, to an injection nozzle of an associated engine, a low pressure supply pump for supplying fuel under pressure to the high pressure pump during the filling periods thereof, passage means connecting the supply pump to an inlet of the high pressure pump, an electrically controlled spill valve operable to divert fuel at high pressure from the high pressure pump during inward movement of the plunger, thereby to control the amount of fuel supplied through said outlet, manual means operable to prevent flow of fuel through the spill valve in the event of electrical failure, a valve associated with said passage means and operable in the event of electrical failure to provide a variable restriction to the flow of fuel through said passage means to the high pressure pump whereby the apparatus can continue to supply fuel to an associated engine, a spill path from the pumping chamber of the high pressure pump, said spill path being uncovered at a predetermined position during inward movement of the plunger to terminate delivery of fuel by the apparatus, an accumulator for storing fuel, said accumulator defining a chamber to which fuel is supplied from the low pressure pump, said passage means communicating with said chamber, and a passage connecting said accumulator chamber with said high pressure pump by way of said spill path.

10. An apparatus according to claim 9 in which said accumulator includes a spring loaded piston slidable in said chamber, said piston being moved by the action of the fuel pressure against the action of the spring and a port formed in the wall of said chamber, said port being uncovered by the piston as the latter is moved against the action of the spring thereby to control the output pressure of the low pressure pump.

* * * * *